United States Patent [19]

Mastronardi

[11] 4,159,664

[45] Jul. 3, 1979

[54] KEYBOARD ASSEMBLY FOR AN ACCORDION

[76] Inventor: Enrico M. Mastronardi, P.O. Box 267, Rte. 1, Chillicothe, Ill. 61523

[21] Appl. No.: 874,793

[22] Filed: Feb. 3, 1978

[51] Int. Cl.[2] ..... G10D 11/00; G10D 11/02

[52] U.S. Cl. ..... 84/376 R; 84/376 K

[58] Field of Search ..... 84/376, 375, 330

[56] References Cited

U.S. PATENT DOCUMENTS

| | | | |
|---|---|---|---|
| 43,226 | 6/1864 | Pries | 84/376 |
| 144,025 | 10/1873 | Goetze et al. | 84/376 R |
| 229,605 | 7/1880 | Grout | 84/365 |
| 365,501 | 6/1887 | Bufe et al. | 84/376 R |
| 530,605 | 12/1894 | Schpanowsky | 84/376 R |
| 978,460 | 12/1910 | Leppert | 84/376 R |
| 1,204,064 | 11/1916 | Preston | 84/361 |
| 2,220,276 | 11/1940 | Price | 84/376 |
| 2,230,162 | 1/1941 | Lidblom | 84/376 |
| 2,502,085 | 3/1950 | Frontalini | 84/376 |
| 3,067,645 | 12/1962 | Moschino | 84/376 |
| 3,311,011 | 3/1967 | Kuehl | 84/376 |
| 3,776,089 | 12/1973 | Cohen | 84/376 |

FOREIGN PATENT DOCUMENTS

| | | | |
|---|---|---|---|
| 55044 | 2/1912 | Switzerland | 84/376 |

*Primary Examiner*—Lawrence R. Franklin

*Attorney, Agent, or Firm*—Wegner, Stellman, McCord, Wiles & Wood

[57] ABSTRACT

Each end box of an accordion has a plurality of keys arranged to control the operation of reeds within the end box with each reed producing a tone corresponding to a note in the chromatic scale which is dissimilar to the tones produced by the other reeds in the end box. The keys are arranged in longitudinal and transverse rows with the interval between adjacent keys in longitudinal rows being major thirds and the interval in transverse rows being minor seconds. The reeds are mounted on multi-celled reed blocks within a tone chamber defined in the interior of the end box. Air flow between the bellows of the accordion and the cells and, hence, through the reeds associated with the cells, is controlled by valve members secured to rods movable axially when the associated keys are depressed.

16 Claims, 4 Drawing Figures

10
12
54
112a
126
122
114
110
127
82
26
64
90
96
56
60
76
94
92
52
128
136
140
134
130
130a
132
62
84
62
74
40
36
34
32
64
116
120
50
112
88
70a
70
116
116
30
146a
146b
146c
102
24
100
14
20

KEYBOARD ASSEMBLY FOR AN ACCORDION

BACKGROUND OF THE INVENTION

This invention relates generally to an accordion and, more particularly, to the arrangement of the reeds within the end boxes of the accordion and the keyboard for controlling the reeds.

Conventional accordions have a pair of end boxes which are joined together by a flexible bellows. By moving the end boxes together or apart, air is forced past reeds within the end boxes or bellows such that the reeds vibrate to produce a selected tone. A keyboard is associated with each end box and has keys or buttons which may be depressed to operate valves within the end box to control the flow of air past selected reeds. Specifically, the right-hand end box has a treble keyboard similar to that of a piano in which each key, when depressed, causes a single note to be played. The left-hand end box has a bass keyboard having a plurality of buttons each of which, when depressed, causes a chord to be played.

The conventional configuration of keyboards severely limits the type of music which can be played, since the octave range for the right hand is limited and since the left hand must play chords rather than single notes. Classical music, for example, is written for a single instrument and sometimes for a pair of pianos. Hence, this music cannot be played without substantial modification and even then the music will lose its original character.

Free bass accordions have been constructed in which the buttons of the bass keyboard control only single tones so that by manipulation of the buttons, scales may be played and desired chords and chord positions may be composed. These free bass accordions employ an extensive number of switches to couple or uncouple octaves for one given key or button in order to produce a larger range of musical sounds. However, some difficulty may be encountered when the switches are operated, especially if a musical composition has a very rapid sequence of significantly different notes.

Further, conventional accordions and free bass accordions have keyboards which are located on the front of the end box. As a result, the thumb of the left hand cannot be used equally with the other fingers of the left hand except on an occasional trick fingering on diminished chords. Accordionists must rely entirely on the four fingers of the left hand without bringing in the thumb for greater execution of the musical composition.

In addition, free bass accordions, which have keys which operate in a manner to produce a single tone or note, duplicate keys so that more than one key or button produces the same tone or note.

SUMMARY OF THE INVENTION

It is the principal object of the invention to provide an accordion in which each end box has a keyboard in which each key is able to control a reed which provides a tone or note of a single pitch which is not produced by the operation of any other key on the keyboard.

In accordance with the invention, an accordion having a bellows defining a flexible air chamber and an end box at each end of the air chamber includes a plurality of tone producing means or reeds within each end box which produces a single tone when air is delivered thereto and a corresponding number of keys, one associated with each reed, to control delivery of air to the reed. Each reed is selected to generate one note of the chromatic scale and together the reeds generate a consecutive series of notes corresponding to each half step of the chromatic scale along a selected interval with each tone produced by each reed being dissimilar to the tone produced by any other reed within the end box.

The keys are arranged on the exterior of their respective end boxes in longitudinal and transverse rows. The interval between notes generated by the reeds operated by adjacent keys in the longitudinal rows is a major third. The interval between notes generated by the reeds operated by adjacent keys in the transverse rows is a minor second.

In an exemplary embodiment of the invention, each end box includes a casing, an enclosures within the casing to define a tone chamber, a plurality of reed blocks within the tone chamber, a plurality of reeds mounted on the reed blocks and a plurality of valve members which are connected to the keys on the keyboard by a valve rod. The reed blocks define a passage between the flexible air chamber within the bellows and each reed. Hence, air which is forced through a selected passage is also forced past the reed associated with that passage to effect vibration thereof and generate a tone. Each of the valve members is associated with one passage and is adapted to be moved to a closed position over one open end of its associated passage so as to seal the one end and prevent air from moving past the associated reed.

A spring is associated with each valve member for urging the valve member toward its closed position over the open end of its associated passage. When the keys are depressed, the valve rods are moved inwardly against the action of the spring associated therewith to move the valve member to an open position away from the open end of the passage to permit air to flow through the passage and past the reed. Hence, a relatively simple method of operating the reed valves can be employed as a result of modifying the arrangement of keys on the external keyboard.

Furthermore, all of the reeds may be enclosed within the tone chamber defined by the enclosure to enhance the character of the notes produced thereby.

In a preferred embodiment of the invention, the end boxes together have the capability of producing notes which include the entire range achievable on the piano, over seven octaves. The right-hand keyboard controls the upper range of notes, while the left-hand keyboard controls the lower range of notes. Herein, each keyboard has a range of over five octaves. Hence, the middle range of notes, i.e., about three octaves, are produced on either keyboard so that fingering during selected compositions is not impaired. The keyboard on each end box is constructed on the side walls of the end box casing. The side of the end box is stepped so that the thumb, as well as the first, second, third and fourth fingers of each hand, may be used equally as needed according to the structure of the musical composition.

A major advantage of an accordion constructed in accordance with the invention is that there is no duplication of keys for either hand and no switches. The keyboard is exactly the same for the left hand and the right hand so that the fingering for either hand is identical. Since there is only one key which will respond with a given pitch, the confusion of deciding which key to depress is no longer a problem.

DESCRIPTION OF THE PREFERRED EMBODIMENT

Figure 1:
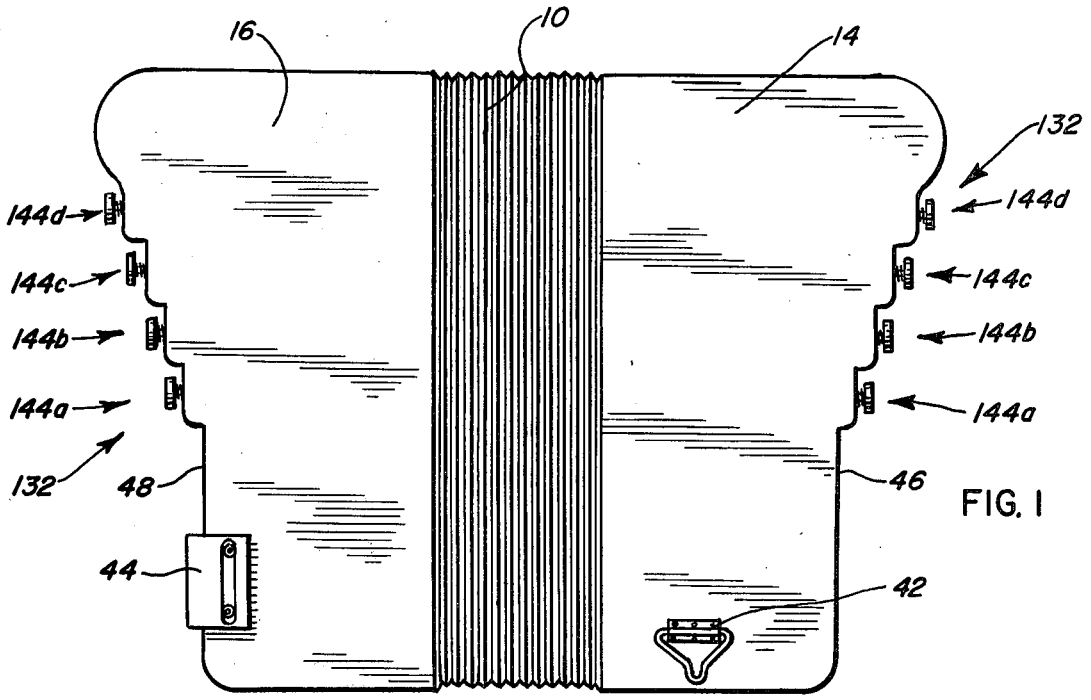
FIG. 1 is a top plan view of an accordion constructed in accordance with the invention.
Figure 3:
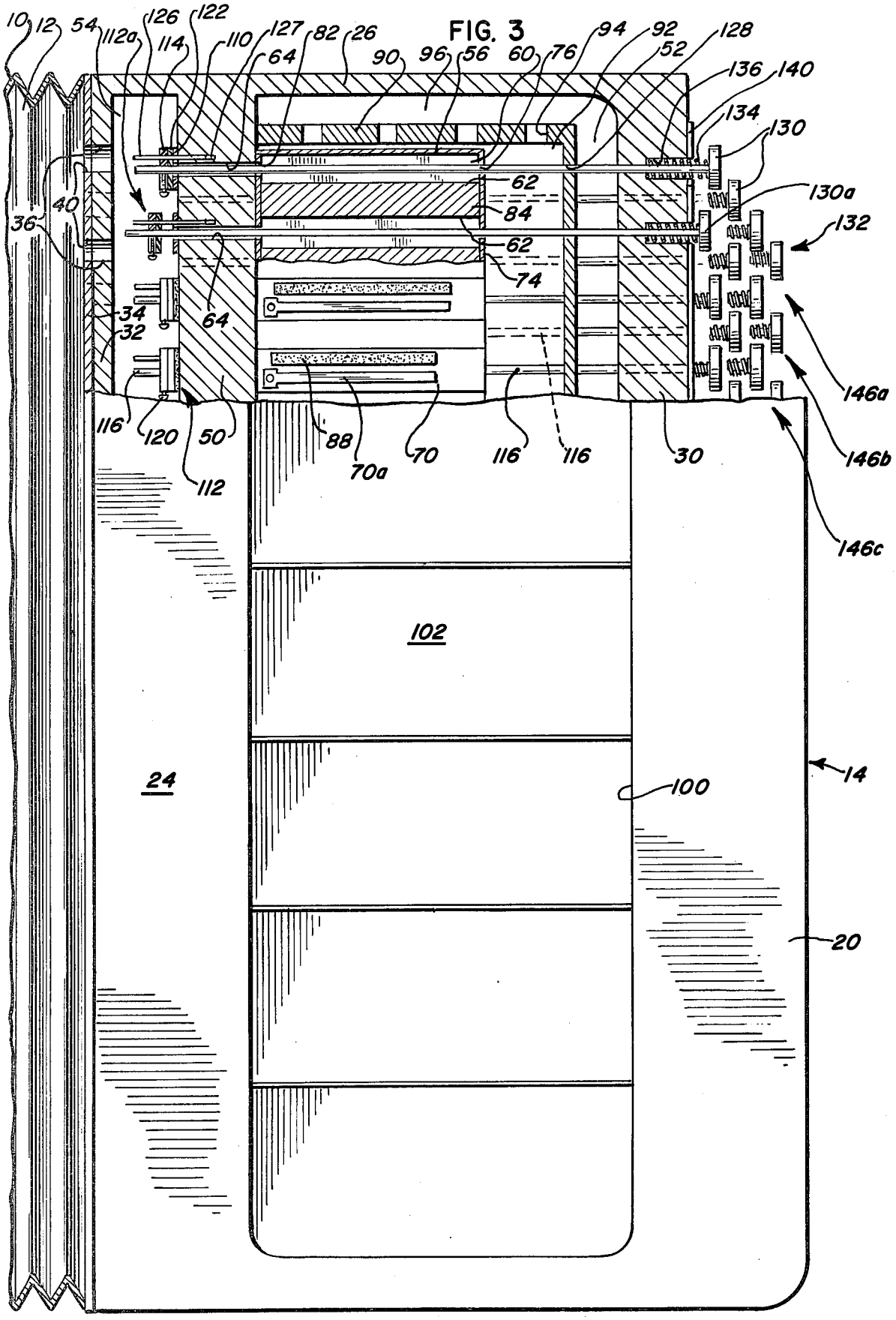
FIG. 3 is a front elevation of the accordion of FIG. 1 with parts broken away to show the reeds, the valves and the keys.
Figure 4:
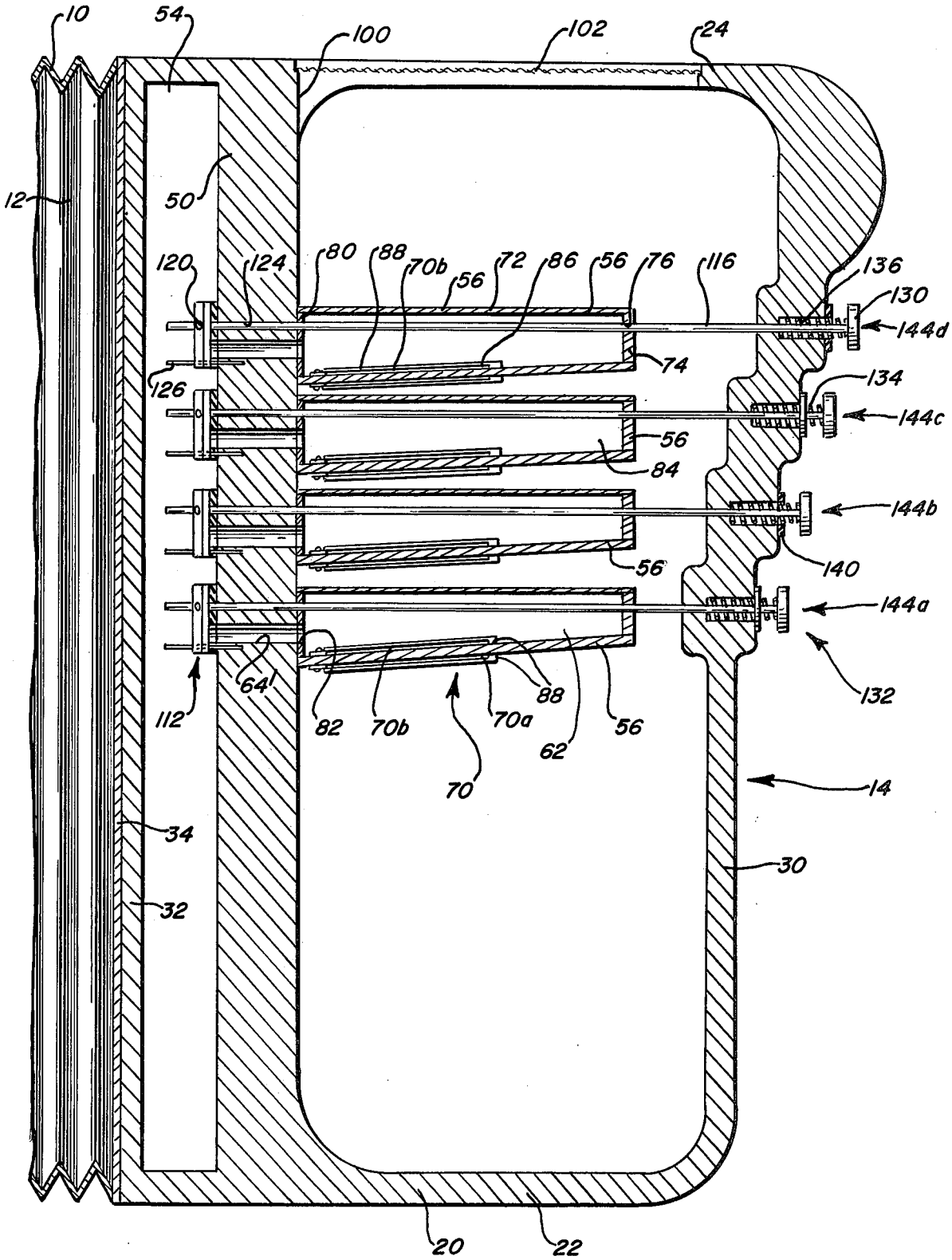
FIG. 4 is a cross-sectional view of the right-hand end box of the accordion of FIG. 1 taken along a horizontal plane with the enclosure defining the tone chamber being removed.

As seen in FIGS. 1, 3 and 4, an accordion constructed in accordance with the invention includes a flexible bellows 10 defining an air chamber, generally designated 12, and a pair of hollow end boxes 14 and 16 secured at opposite ends of the bellows 10. By moving the end boxes 14 and 16 together or apart, air is forced from the bellows 10 into the end boxes 14 and 16 or sucked from the end boxes 14 and 16 into the bellows 10.

Since each end box 14 or 16 is constructed in a similar manner, in the interest of brevity and clarity, only the right-hand end box 14 will be described in detail. The end box 14 has an outer casing 20 defined by a back wall 22, a front wall 24, a top wall 26, a bottom wall (not numbered), a side wall 30, and an interior wall 32 extending between and connecting the back and front walls 22 and 24. The bellows 10 has an end 34 to which the interior wall 32 of the end box 14 is suitably secured. A plurality of passages 36 are formed in the interior wall 32 and aligned with corresponding passages 40 formed in the bellows end 34 to provide fluid communication between the flexible air chamber 12 and the interior of the end box 14 and permit air to flow freely therebetween.

In use, the relatively narrow back wall 22 rests against the chest of the accordionist. A shoulder strap (not shown) may be connected to a holder 42 which is suitably fixed to the top wall 26 of the right end box 14. A left-hand pull strap (not shown) is, in turn, connected to the holder 44 which is suitable fixed to the left end box 16. A right-hand palm rest plate is located at 46, while a left-hand palm rest plate is located at 48. Generally, the right-hand end box 14 is maintained in relatively stationary position, while the left-hand end box 16 is moved toward and away from the right-hand end box 14 by pushing and pulling the left-hand end box 16 to respectively collapse and expand the bellows 10.

Spaced slightly from the interior wall 32 is a reed block plate 50 which extends between the back wall 22 and the front wall 24 and between the top wall 26 and the bottom wall thereby defining an internal chamber 52 within the casing 20 and a secondary chamber 54.

Four multi-celled reed blocks, each designated 56, are mounted to the plate 50 and extend into the internal chamber 52. As seen in FIG. 3, each reed block 56 has a longitudinal series of passages or cells 60 formed therein which are separated by dividing walls 62. The cells 60 have an inward end which communicates with the secondary chamber 54 via openings 64 formed in the reed block plate 50. Situated over the cells 60 are conventional reeds 70 mounted on the reed blocks 56 which vibrate to produce a tone when air passes therethrough.

Herein, each reed block 56 has a trapezoidal cross section and is formed from a continuous back plate 72, a continuous top plate 74 with a longitudinal series of valve rod holes 76 formed therein, a continuous bottom plate 80 with a longitudinal series of openings 82 aligned with the openings 64, and a series of dividing blocks 84 to define and separate the open cells 60. As should be apparent, a reed 70 is placed across the open side of each cell so that air flowing through the cell 60 in either direction flows through the overlying reed. One or more reeds 70 may be secured across the passage to achieve the volume desired, each producing a similar tone.

The reed 70 is conventional and has two reeds 70*a* and 70*b*, one of the reeds 70*a* or 70*b* vibrating in accordance with the direction of air flowing therepast. Leather covers 88 are positioned on one side of each reed, as is well-known. Because of the tapered configuration of the reed blocks 56, the reeds 70*a* and 70*b*, when vibrating, will not come in contact with the adjacent reed block 56.

Disposed about the four reed blocks 56 is an enclosure 90 spaced inwardly from the outer casing 20 which defines a sound chamber or tone chamber 92. Apertures 94 permit air to flow between the tone chamber 92 and the space 96 defined between the enclosure 90 and the casing 20 within the internal chamber 52. An opening 100 in the front wall 24, which is covered by a grill cloth 102, permits air to flow between the internal chamber and the atmosphere.

Each opening 64, which is surrounded with an annular resilient pad 110, is sealed by a separate valve member, generally designated 112. The valve member 112 includes an annular shoulder member 114 and an annular resilient pad 122 mounted on the shoulder member 114. The shoulder member 114 is adjustably fixed to the inward or proximal end of a valve rod 116 by a set screw 120 so that the length of travel of the valve rod 116 may be modified as desired. The pad 122 is of such diameter so as to be adapted to seat against the pad 110 to close the opening 64 and prevent air from passing between the bellows 10 and the cell 60 thereby preventing vibration of the reeds 70*a* and 70*b* of the reed 70. The valve rod 116 extends through the openings 64 and 82. However, in FIG. 4, an alternative construction is shown in which the valve rod 116 does not pass through the same opening as the air, but through a bore 124. Referring to FIG. 3, it is seen that movement of the valve rod 116 axially inward causes the valve member 112 to move away from its seat against the pad 110 so that air may flow between the pads 110 and 122, as illustrated by valve member 112*a*, and through the reed 70. A guide pin 126 attached to the valve member 112 and sliding within bore 127 effects proper positioning of the valve member 112 on the pad 110 over the opening 64.

Each valve rod 116 extends outwardly successively through the reed block plate 50, the openings 64 and 82, the cell 60, the bore 76 in the end wall 74 of the reed block 56, a bore 128 formed in the enclosure 90 and the keyboard plate on the side wall 30 of the casing 20. Suitable means are provided to prevent air from escaping along the valve rods 116. Fixed to the outer or distal end of the valve rods 116 are external buttons or keys 130, which comprise the keyboard, generally designated 132, to be described later in greater detail. Springs 134 are placed between the keys 130 and the buttoms of spring holes 136 to urge the valve rods 116 axially outward so as to bias the valve members 112 to closed position. A pad 140 overlies the exterior of the side wall 30 underneath the keys 130 to reduce the noise produced when the keys 130 are depressed against the side wall 30.

The keys 130 are arranged in longitudinal and transverse rows 144 and 146, respectively. Each longitudinal row 144 is arranged along a line extending between the top and bottom of the casing 20, while each transverse row 146, which is oblique to the longitudinal rows 144, is arranged along a line extending between the front and back of the casing 20. As best seen in FIGS. 1 and 4, the side wall 30 is stepped so that each longitudinal row 144 resides at a different level. The key rows nearer the front of the casing 20 are higher than the rows near the back of the casing to assist in the ease of manipulation of the keys by the accordionist. In use, the back wall 22 is positioned against the chest of the accordionist and the side wall 30 extends outwardly away from the accordionist so that the keys furthest away from the accordionist are higher. As should be apparent, the keys 130 in each longitudinal row 144 have a similar length of travel when they are depressed.

Each reed 70 is selected to generate one note of the chromatic scale regardless of whether air is forced from the cell 60 through the reed 70 or sucked through the reed 70 into the cell 60. Together, the reeds 70 generate a consecutive series corresponding to each half step of the chromatic scale along a selected interval. The tone generated by each reed 70 is dissimilar to the tone generated by any other reed within the end box 14. The reeds 70 are mounted on the reed blocks 56 so that a single key 130 operates the valve member 112 controlling flow of air through the reed. The number of reed blocks 56 corresponds to the number of longitudinal rows, while the number of cells in a particular reed block corresponds to the number of keys in the longitudinal rows associated therewith.

The reeds 70 are arranged on the respective reed blocks 56 such that the intervals between notes generated by reeds associated with adjacent keys in a longitudinal row 144 are major thirds, and the intervals between notes generated by the reeds associated with adjacent keys in a transverse row 146 are minor seconds. Hence, each transverse row 146 has four keys.

Figure 2:
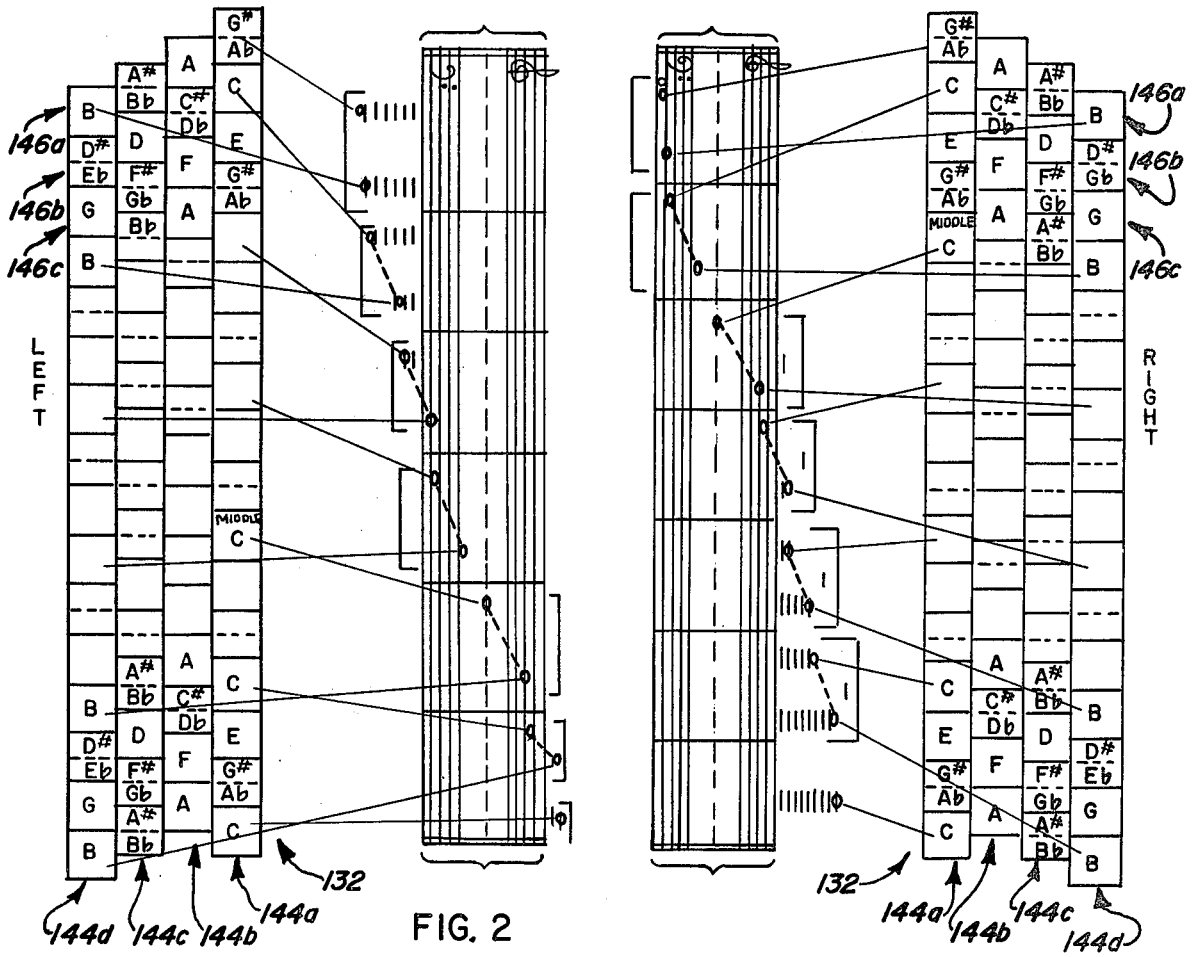
FIG. 2 is a schematic diagram of the right- and left-hand accordion keyboards arranged in accordance with the invention and showing the notes on the staff associated with the keys.

As best illustrated in FIG. 2, the keys of the right-hand end box 14 control the high range of tones, while the keys of the left-hand box 16 control the low range of tones. A typical embodiment, as illustrated in FIG. 2, has a keyboard 132 with 65 keys spanning slightly more than five octaves with an overlap of three octaves between the right-hand and left-hand keyboards. One transverse row 146*a* has keys which control the reeds for G#/Ab, A, A#/Bb and B; the next transverse row 146*b* has keys for C, C#/Db, D and D#/Eb; the third transverse row 146*c* has keys for E, F, F#/Gb and G. Hence, three adjacent transverse rows generate one octave. The four longitudinal rows which include these keys are, therefore, repeatedly arranged so that longitudinal row 144*a* has keys for G#/Ab, C and E, longitudinal row 144*b* has keys for A, C#/Db, and F, longitudinal row 144*c* has keys for A#/Bb, D and F#/Gb, and longitudinal row 144*d* has keys for B, D#/Eb, and G. There are sixteen transverse rows with a seventeenth key, "C", in longitudinal rows 144 *a*.

To facilitate identification of the keys, especially for beginners, the keys are color coded. The keys of the natural notes are white. The keys of the flat and sharp notes are red and blue. Since each sharp note is equivalent to a corresponding flat note, the top of a key producing such a note is red for the sharp and the bottom is blue for the flat. Further, the key for middle C on each keyboard is colored orange.

By referring to FIG. 2 so that both keyboards can be viewed simultaneously, the playing of the C major scale can be described for illustration. When the thumb of the left hand is placed on any C in the first longitudinal row 144*a* of the left-hand keyboard and the thumb of the right hand is placed on any C which is also in the first longitudinal row 144*a* on the right-hand keyboard, the first note is played. By proceeding to D in the third longitudinal rows 144*c* with the second fingers of each hand and then to E in the first longitudinal rows 144*a* with the thumbs, the second and third notes are played. By proceeding next to F in the second longitudinal rows 144*b* with the second fingers and to G in the fourth longitudinal rows 144*d* with the third fingers, the fourth and fifth notes of the scale are played. By playing A on the second longitudinal rows 144*b* with the thumbs, and then B on the fourth longitudinal rows 144*d* with the third fingers, and finally C, an octave higher than the C that started with the thumbs, the sixth seventh and final notes can be played. This illustrates that either hand can be executed with exactly the same fingering sequence for music, chords or scales. This is made possible by physically arranging the two keyboards on the end cases to be mirror images of each other, to correspond to the right and left hands of the player being mirror images of each other, and by making corresponding keys of each keyboard to operate tone generators of notes having the same note names. The latter arrangement presents the notes of the chromatic scales in the same relationship to each hand of the player. Being presented to each hand in the same relationship allows each hand to execute the same music, chords or scales with the same technique. It should be noted that although correponding keys relate to notes having the same note names, the tones of the notes are not the same, as can be seen by comparing in FIG. 2 the top four transverse rows of each keyboard with the notes associated therewith on the two staves.

I claim:

1. In an accordion having a bellows defining a flexible air chamber and an end box at each end of said air chamber, the improvement comprising:

a casing defining each of said end boxes including a back wall adapted to be placed adjacent the body of the accordionist, a front wall, and a side wall connected between said back and front walls extending away from the accordionist;

a plurality of means in each end box each producing a single tone when air is delivered thereto from said bellows, each tone producing means being selected to generate one note of the chromatic scale and together generating a consecutive series of notes corresponding to each half step of the chromatic scale along a selected interval, each tone produced by one of said tone producing means in one end box being dissimilar to the tones produced by each of the other tone producing means in said one end box; and a corresponding number of keys one associated with each of said tone producing means and having means for operating its respective tone producing means by controlling delivery of air thereto from said bellows, said keys being located on the exterior of said side walls of said casing, extending and actuated in a direction generally parallel to said back and front walls and arranged in longitudinal and transverse rows for manual manipulation by an accordionist, the physical arrangement of the keys on one end casing being the mirror image of that on the other end casing and corresponding keys on each end casing operating tone producing means for notes having the same note names, the interval between notes generated by the tone producing means operated by adjacent keys in the longitudinal rows being in major thirds and the interval between notes generated by the tone producing means operated by adjacent keys in the transverse rows being in minor seconds.

2. The accordion of claim 1 wherein there are four keys in each transverse row.

3. The accordion of claim 2 wherein each transverse row of keys extends in a direction between said back and front walls and each longitudinal row is generally parallel with said back wall.

4. The accordion of claim 3 wherein said transverse rows are oblique to said longitudinal rows.

5. The accordion of claim 1 wherein the longitudinal rows of keys are arranged on progressively higher levels of said side walls, the longitudinal row of keys positioned nearest said back wall being at the lowest level and the longitudinal row of keys positioned farthest from said back wall being at the highest level.

6. The accordion of claim 5 wherein the keys in three consecutive transverse rows operate tone producing means with one transverse row controlling the notes of G#/Ab, A, A#/Bb and B, the second transverse row controlling the notes of C, C#/Db, D and D#/Eb, the third transverse row controlling the notes of E, F, F#/Gb and G, respectively, with the four consecutive longitudinal rows including these keys thereby having keys arranged such that one longitudinal row controls the notes of G#/Ab, C and E, the second longitudinal row controls the notes of A, C#/Db and F, the third longitudinal row controls the notes of A#/Bb, D and F#/Gb, and the fourth longitudinal row controls the notes of B, D#/Eb and G, respectively.

7. In a musical instrument including a bellows defining a flexible air chamber and an end box at each end of said air chamber, each end box comprising:

a casing secured to said bellows;

a reed block plate mounted between said casing and said bellows to define an internal chamber within said casing, said casing having an opening to provide communication between said internal chamber and the exterior thereof;

enclosure means for defining a tone chamber within said internal chamber including walls spaced from said casing with an opening therein to permit air to pass from said tone chamber into the space between said casing and said walls;

a plurality of reed blocks within said tone chamber each being mounted to said reed block plate, each reed block defining at least one cell including passage means at one end of each cell providing communication between said flexible air chamber and its respective cell;

a plurality of reeds mounted on said reed blocks with at least one overlying each cell to at least partially define the cell such that air moved through the cell flows past the respective reed to effect vibration thereof to generate a tone, each reed selected to generate one note of the chromatic scale and together generating a consecutive series of notes corresponding to each half step of the chromatic scale along a selected interval, the tone generated by each reed being dissimilar to the tones generated by any of the other reeds;

a keyboard on said casing including an external key associated with each passage and adapted to be manually depressed by an accordionist, said keys being arranged on the exterior of said casing in longitudinal and transverse rows, the interval between notes generated by the reeds associated with adjacent keys in the longitudinal rows being in major thirds and the interval between notes generated by the reeds associated with adjacent keys in the transverse rows being in minor seconds;

a plurality of valve rods one secured to each key at one end thereof and extending through said internal chamber and said reed block plate to move axially inward as its associated key is depressed;

a plurality of valve members one secured to the other end of each valve rod, a valve member being disposed at said one end of each cell and being adapted to be moved axially outward toward a closed position over said one end to prevent air from moving between said flexible air chamber and said cell and axially inward toward an open position spaced from said one end to permit air to move between said flexible air chamber and said cell and flow past the respective reed; and biasing means for urging each of said valve members axially outward to said closed position over their respective open ends.

8. The musical instrument of claim 7 wherein the number of reed blocks corresponds to the number of longitudinal rows of keys, one reed block being associated with each longitudinal row of keys, each reed block being multi-celled with the number of cells corresponding to the number of keys associated with the reed block.

9. The musical instrument of claim 8 wherein each valve rod extends through its associated reed block, through the cell associated with the valve rod and through the passage in communication with said flexible air chamber.

10. In a musical instrument including a bellows defining a flexible air chamber and an end box at each end of said air chamber, each end box comprising:

a casing secured to said bellows;

a reed block plate mounted between said casing and said bellows to define an internal chamber within said casing, said casing having an opening to provide communication between said internal chamber and the exterior thereof;

enclosure means for defining a tone chamber within said internal chamber including walls spaced from said casing with an opening therein to permit air to pass from said tone chamber into the space between said casing and said walls;

a plurality of reed blocks within said tone chamber each being mounted to said reed block plate, each reed block defining at least one cell and passage means at one end of each cell providing communication between said flexible air chamber and its respective cell;

a plurality of reeds mounted on said reed blocks with at least one overlying each cell to at least partially define the cell such that air moved through the cell flows past the respective reed to effect vibration thereof to generate a tone, the tone generated by each reed being dissimilar to the tones generated by any of the other reeds within the end box;

a keyboard on said casing including an external key associated with each cell and adapted to be manually depressed by an accordionist;

a plurality of valve rods one secured to each key at one end thereof and extending through said internal chamber and said reed block plate to move axially inward as its associated key is depressed;

a plurality of valve members one secured to the other end of each valve rod, a valve member being disposed at said one end of each cell and being adapted to be moved axially outward toward a closed position over said one end to prevent air from moving between said flexible air chamber and said cell and axially inward toward an open position spaced from said one end to permit air to move between said flexible air chamber and said cell and flow past the respective reed; and biasing means for urging each of said valve members axially outward to said closed position over their respective open ends.

11. The musical instrument of claim 10 wherein said casing has a side wall which extends away from the accordionist when the instrument is played and upon which the keyboard is arranged.

12. The musical instrument of claim 11 wherein said reed blocks extend from said reed block plate toward said side wall with said valve rods extending through said reed blocks.

13. The musical instrument of claim 12 wherein said valve rods extend through said cells in said reed blocks and through passage means at the ends thereof communicating with said flexible air chamber, each valve member being disposed about its respective valve rod and being of a diameter to seal said passage means when moved to a closed position.

14. The musical instrument of claim 13 further including means for adjustable securing said valve members to said valve rods to permit modification of the amount of travel thereof.

15. The musical instrument of claim 11 wherein said keys are arranged in longitudinal and transverse rows, each longitudinal row being arranged along a line extending between the top and bottom of the casing and each transverse row being arranged along a line extending between the front and back of the casing, the keys in adjacent longitudinal rows being positioned at different levels with the rows nearer the front of the casing being higher than the rows nearer the back of the casing.

16. The musical instrument of claim 15 wherein the side wall of said casing is stepped with the side wall having higher levels nearer the front than at the back, each longitudinal row of keys residing at a different level and movement of said keys being limited so that each key has the same amount of travel when depressed against said side wall.

* * * * *